US010900385B2

(12) United States Patent
Uckermark

(10) Patent No.: US 10,900,385 B2
(45) Date of Patent: Jan. 26, 2021

(54) SWITCHABLE ROCKER ARM

(71) Applicant: DELPHI TECHNOLOGIES IP LIMITED, St. Michael (BB)

(72) Inventor: Chad E. Uckermark, Warwick, NY (US)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/260,769

(22) Filed: Jan. 29, 2019

(65) Prior Publication Data

US 2020/0240295 A1 Jul. 30, 2020

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 2001/186* (2013.01)

(58) Field of Classification Search
CPC . F01L 1/185; F01L 13/0005; F01L 2001/186; F01L 1/18; F01L 1/181; F01L 13/0015; F01L 2105/00; F01L 2001/467; Y10T 74/20882
USPC ..... 123/90.39, 90.44
See application file for complete search history.

(56) References Cited

U.S. PATENT DOCUMENTS 6,467,445 B1 10/2002 Harris
6,604,498 B2 8/2003 Fernandez et al.
6,668,779 B2 12/2003 Hendriksma et al.
6,925,978 B1 8/2005 Gerzseny et al.
7,305,951 B2 12/2007 Fernandez et al.
7,677,213 B2 3/2010 Deierlein
7,798,113 B2 9/2010 Fischer et al.
7,882,814 B2 2/2011 Spath et al.
7,926,455 B2 4/2011 Manther et al.
2001/0035140 A1 11/2001 Fernandez et al.
2001/0045197 A1 11/2001 Fernandez et al.
2004/0103869 A1 6/2004 Harris
2005/0132989 A1 6/2005 Hendriksma et al.
2006/0249110 A1 11/2006 Fernandez et al.
2012/0037107 A1 2/2012 Church
2012/0266835 A1 10/2012 Harman
2014/0209048 A1* 7/2014 Manther ..... F01L 13/0005 123/90.39
2014/0290608 A1 10/2014 Radulescu
2016/0003111 A1* 1/2016 Evans ..... F01L 1/205 123/90.45

(Continued)

*Primary Examiner* — Devon C Kramer
*Assistant Examiner* — Kelsey L Stanek
(74) *Attorney, Agent, or Firm* — Joshua M. Haines

(57) ABSTRACT

A rocker arm includes an outer arm having a first wall surface, a second wall, and a third wall surface together forming a lock member channel. An inner arm selectively pivots relative to the outer arm about a pivot axis. A lost motion spring biases the inner arm to pivot relative to the outer arm in a first direction about the pivot axis. A lock member is located within the lock member channel which moves along a lock member axis between a coupled position which prevents the inner arm from pivoting about the pivot axis and a decoupled position which permits the inner arm to pivot relative to the outer arm. A lock member retainer is spaced apart from, and opposed to, the third wall surface such that the lock member is captured between the lock member retainer and the third wall surface.

19 Claims, 5 Drawing Sheets

(56) References Cited

U.S. PATENT DOCUMENTS

| | | | | |
|---|---|---|---|---|
| 2016/0102584 | A1* | 4/2016 | Evans | F01L 13/0036 123/90.45 |
| 2016/0312666 | A1* | 10/2016 | Manther | F01L 13/0005 |
| 2017/0074128 | A1* | 3/2017 | Zurface | F01L 1/185 |
| 2017/0321574 | A1* | 11/2017 | Ahmed | F01L 1/18 |
| 2018/0023425 | A1* | 1/2018 | Ahmed | F01L 13/0005 74/527 |
| 2018/0045081 | A1* | 2/2018 | Rehm | F01L 13/0005 |
| 2018/0045082 | A1* | 2/2018 | Foster | F01L 1/20 |
| 2018/0238198 | A1* | 8/2018 | Uckermark | F01L 1/185 |
| 2019/0063267 | A1* | 2/2019 | West | F01L 1/18 |
| 2019/0257220 | A1* | 8/2019 | Borraccia | F01L 1/2405 |

* cited by examiner

SWITCHABLE ROCKER ARM

TECHNICAL FIELD OF INVENTION

The present invention relates to a rocker arm for valve train of an internal combustion engine; more particularly to a rocker arm with an inner arm which selectively pivots relative to an outer arm, and even more particularly to such a rocker arm which includes a lock member for selectively preventing the inner arm from pivoting relative to the outer arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency of the internal combustion engine.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second valve lift mode, that is greater than no lift. It should be noted that the second valve lift mode may provide one or both of increased lift magnitude and increased lift duration or one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm where the inner arm includes an inner arm follower which follows a first profile of a camshaft of the internal combustion engine and where the outer arm may include a pair of outer arm followers which follow respective second and third profiles of the camshaft. The follower of the inner arm and the followers of the outer arm may be either sliding surfaces or rollers and combinations thereof. The inner arm is movably connected to the outer arm and can be switched from a coupled state wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster which fits into a socket of the outer arm. A second end of the outer arm operates against an associated engine valve for opening and closing the valve by the rotation of an associated eccentric cam lobe acting on the follower of the inner arm. The inner arm is connected to the outer arm for pivotal movement about the outer arm's second end with the follower of the inner arm disposed between the first and second ends of the outer arm. Switching between the coupled state and the decoupled state is accomplished through a lock pin which is slidingly positioned in a lock pin bore of the outer arm. One end of the lock pin is moved into and out of engagement with the inner arm. Consequently, when the lock pin is engaged with the inner arm, the coupled state is achieved. Conversely, when the lock pin is not engaged with the inner arm, the decoupled state is achieved.

As shown in U.S. Pat. No. 7,305,951 to Fernandez et al., the disclosure of which is hereby incorporated by reference in its entirety, the other end of the lock pin acts as a piston upon which pressurized oil is applied and vented to affect the position of the lock pin. Also as shown by Fernandez et al., oil is supplied to the lock pin via an oil supply bore which originates in the socket and breaks into the lock pin bore. Other known switchable rocker arms are disclosed in U.S. Pat. No. 7,677,213 to Deierlein and U.S. Pat. No. 7,926,455 to Manther et al. However, alternatives and variations are continually sought in any art.

SUMMARY OF THE INVENTION

Briefly described, and in accordance with the present invention, a rocker arm for transmitting rotational motion from a camshaft to opening and closing motion of a combustion valve in an internal combustion engine includes an outer arm having a first wall surface, a second wall surface opposed to, and spaced apart from, the first wall surface, and a third wall surface which joins the first wall surface to the second wall surface, the first wall surface, the second wall surface, and the third wall surface together forming a lock member channel which is open in a direction opposed to the third wall surface; an inner arm which selectively pivots relative to the outer arm about a pivot axis; a lost motion spring which biases the inner arm to pivot relative to the outer arm in a first direction about the pivot axis; a lock member located within the lock member channel which moves along a lock member axis between 1) a coupled position in which the lock member prevents the inner arm from pivoting about the pivot axis relative to the outer arm past a predetermined position of the inner arm relative to the outer arm in a second direction which is opposite of the first direction and 2) a decoupled position in which the lock member permits the inner arm to pivot relative to the outer arm past the predetermined position in the second direction about the pivot axis; and a lock member retainer which is spaced apart from, and opposed to, the third wall surface such that the lock member is captured between the lock member retainer and the third wall surface, thereby limiting movement of the lock member away from the third wall surface in a direction perpendicular to the lock member axis.

The rocker arm described herein is simple and economic to produce.

BRIEF DESCRIPTION OF DRAWINGS

This invention will be further described with reference to the accompanying drawings in which.

DETAILED DESCRIPTION OF INVENTION

Figure 1:
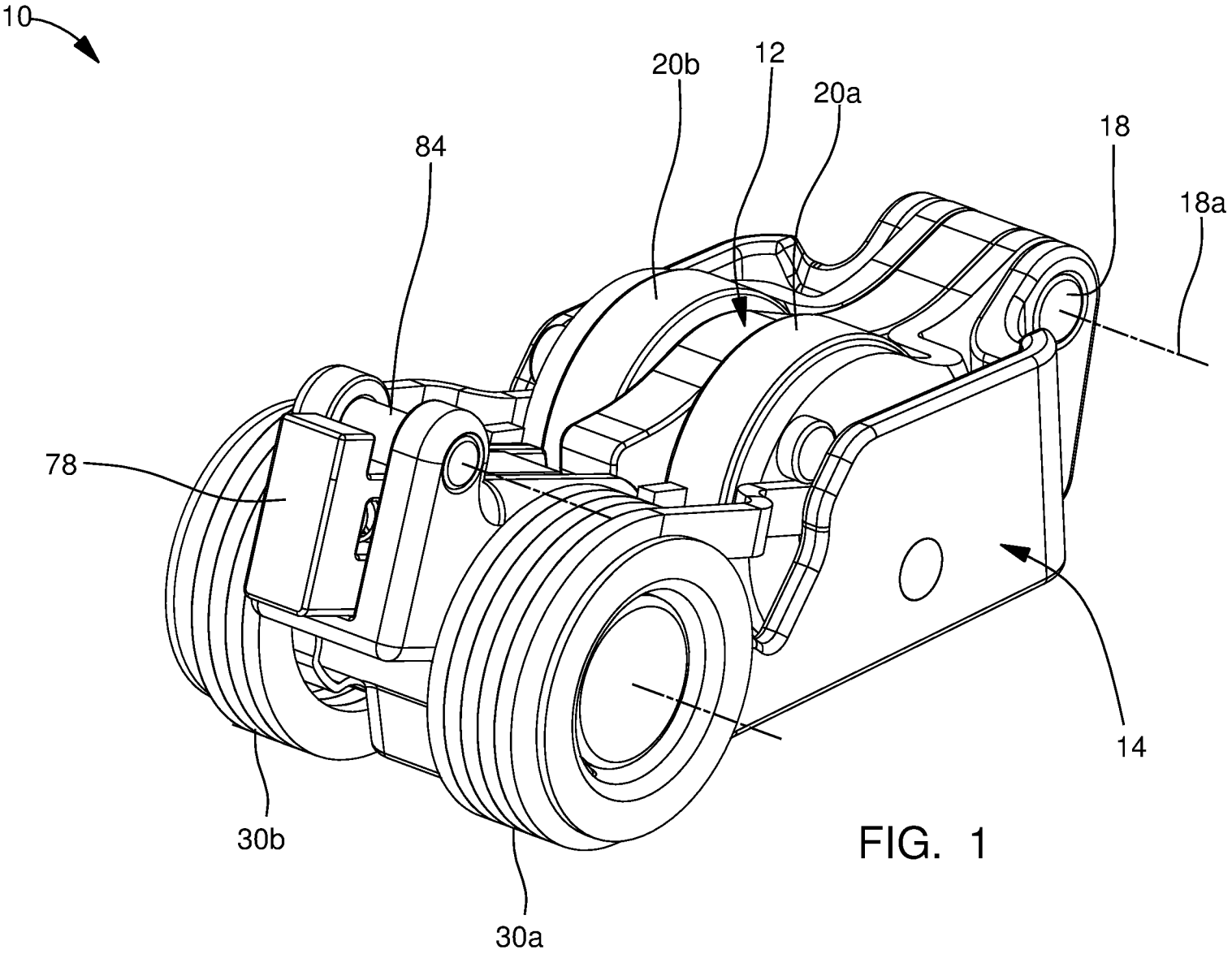
FIG. 1 is an isometric view of a rocker arm in accordance with the present invention.
Figure 2:
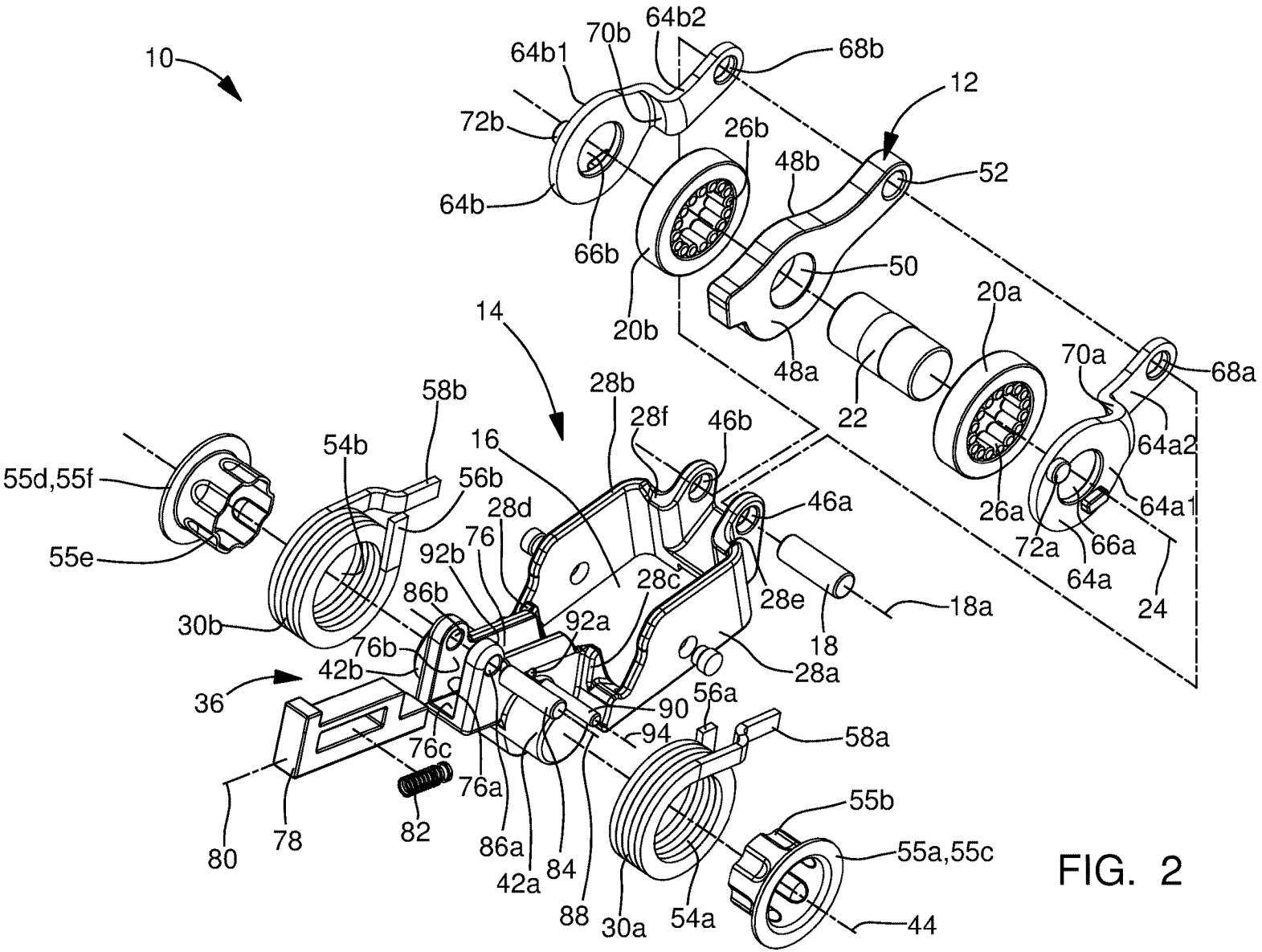
FIG. 2 is an exploded isometric view of the rocker arm of FIG. 1.

Referring to FIGS. 1-5, a rocker arm 10 in accordance with the invention is illustrated where rocker arm 10 is presented for illustrative purposes as a deactivation rocker arm but may alternatively be a two-step rocker arm, both of which may generically be referred to as a switchable rocker arm. Rocker arm 10 is included in valve train (not shown) of an internal combustion engine (not shown) in order to translate rotational motion of a camshaft 11 about a camshaft axis 11*a* to reciprocating motion of a combustion valve (not shown). As is known in the art of combustion valve actuation, camshaft 11 includes a base circle 11*b* which is centered about camshaft axis 11*a* and a lifting portion 11*c* which is eccentric to camshaft axis 11*a*. In this way, base circle 11*b* does not induce movement on the combustion valve while lifting portion 11*c* opens and closes the combustion valve. Rocker arm 10 includes an inner arm 12 that is pivotably disposed in a central opening 16 in an outer arm 14. Inner arm 12 selectively pivots within outer arm 14 on a pivot shaft 18 about a pivot axis 18*a* such that pivot shaft 18 extends along, and is centered about, pivot axis 18*a*. Inner arm 12 carries or supports a pair of followers illustrated as a first roller 20*a* and a second roller 20*b* carried by a roller shaft 22 that is supported by inner arm 12 such that first roller 20*a*, second roller 20*b*, and roller shaft 22 are each centered about, and extend along, a roller shaft axis 24. First roller 20*a* and second roller 20*b* are configured to follow base circle 11*b* and lifting portion 11*c*, to selectively impart lifting motion on a respective combustion valve. First roller 20*a* and second roller 20*b* are each cylindrical and tubular as shown. A plurality of first bearings 26*a* may rotatably support first roller 20*a* on roller shaft 22 for following base circle 11*b* and lifting portion 11*c* of camshaft 11 while a plurality of second bearings 26*b* may rotatably support second roller 20*b* on roller shaft 22 for following base circle 11*b* and lifting portion 11*c* of camshaft 11. First bearings 26*a* and second bearings 26*b* may be, for example, a plurality of rollers or needle bearings. Outer arm 14 includes a first wall 28*a* and a second wall 28*b* which are parallel to each other such that first wall 28*a* and second wall 28*b* are perpendicular to roller shaft axis 24 and such that first wall 28*a* and second wall 28*b* are spaced apart from each other in the direction of roller shaft axis 24 to define central opening 16 therebetween. As illustrated in the figures, first wall 28*a* and second wall 28*b* may each have discrete sections which cause first wall 28*a* and second wall 28*b* to be spaced apart from each other by different distances. A first lost motion spring 30*a* and a second lost motion spring 30*b* each act between inner arm 12 and outer arm 14 to pivot inner arm 12 away from outer arm 14 in a first direction, shown as clockwise as viewed in FIGS. 3 and 4, about pivot axis 18*a*. A socket 32 for pivotably mounting rocker arm 10 on a lash adjuster (not shown) is included at a first end 14*a* of outer arm 14 while a pad 34 for actuating a valve stem (not shown) is proximal to a second end 14*b* of outer arm 14. A latching arrangement 36 disposed within outer arm 14 proximal to first end 14*a* thereof selectively permits inner arm 12 to pivot relative to outer arm 14 about pivot axis 18*a* and also selectively prevents inner arm 12 from pivoting relative to outer arm 14 about pivot axis 18*a* in a second direction, illustrated as counterclockwise as viewed in FIGS. 3 and 4, which is opposite of the first direction. While outer arm 14 has been illustrated herein as not including followers which follow respective profiles of camshaft 11, it should be understood that outer arm 14 may include followers such as rollers as shown in U.S. Pat. No. 7,305,951 or such as sliding surfaces as shown in U.S. Pat. No. 7,882,814 to Spath et al. and U.S. Pat. No. 6,668,779 to Hendriksma et al., the disclosures of each of which are hereby incorporated by reference in their entirety. When included, the followers of the outer arms are utilized to follow a profile of camshaft 11 which is a circle in the case of rocker arm 10 being a deactivation rocker arm and the followers of the outer arm are utilized to follow a profile of camshaft 11 which includes an eccentric portion similar to lifting portion 11*c* which provides a different magnitude or duration of lifting motion to rocker arm 10 in the case of rocker arm 10 being a two-step rocker arm. Furthermore, while inner arm 12 has been illustrated herein as including two followers illustrated as first roller 20*a* and second roller 20*b*, it should be understood that inner arm may include only a single roller, or may alternatively use one or more sliding surfaces as the follower instead of a roller as illustrated in U.S. Pat. No. 7,305,951.

Outer arm 14 includes an outer arm body 38 at first end 14*a* and an outer arm bridge 40 at second end 14*b*. Outer arm body 38 joins first wall 28*a* and second wall 28*b* at first end 14*a* and also defines socket 32 therein. Similarly, outer arm bridge 40 joins first wall 28*a* and second wall 28*b* at second end 14*b* and also defines pad 34 thereon. First wall 28*a*, second wall 28*b*, outer arm body 38, and outer arm bridge 40 may comprise a single piece of material which is formed, by way of non-limiting example only, by casting, forging, machining from solid, combinations thereof, and the like. Proximal to first end 14*a*, first wall 28*a* includes a first spring boss 42*a* extending outward therefrom and similarly, second wall 28*b* includes a second spring boss 42*b* extending outward therefrom such that first spring boss 42*a* and second spring boss 42*b* are each centered about, and extend along a spring boss axis 44 which is parallel to pivot axis 18*a*. First spring boss 42*a* and second spring boss 42*b* are each preferably circular in cross-section when sectioned perpendicular to spring boss axis 44 and are preferably formed as a single piece of material with first wall 28*a*, second wall 28*b*, outer arm body 38, and outer arm bridge 40. Between first end 14*a* and second end 14*b*, first wall 28*a* and second wall 28*b* include a first wall step 28*c* and a second wall step 28*d* respectively which cause first wall 28*a* and second wall 28*b* to be spaced further apart in order to accommodate inner arm 12, first roller 20*a*, and second roller 20*b*. Proximal to second end 14*b*, first wall 28*a* and second wall 28*b* include a first wall step 28*e* and a second wall step 28*f* respectively which cause first wall 28*a* and second wall 28*b* to be in closer proximity to each other. Also proximal to second end 14*b*, first wall 28*a* includes a first pivot shaft aperture 46*a* extending therethrough and similarly, second wall 28*b* includes a second pivot shaft aperture 46*b* extending therethrough. First pivot shaft aperture 46*a* and second pivot shaft aperture 46*b* are each centered about, and extend along, pivot axis 18*a* and each receive a portion of pivot shaft 18 therein in order to support pivot shaft 18 by outer arm 14. Pivot shaft 18 interfaces with first pivot shaft aperture 46*a* and second pivot shaft aperture 46*b* in a close sliding interface or an interference fit which prevents radial movement of pivot shaft 18 within first pivot shaft aperture 46*a* and second pivot shaft aperture 46*b*. Pivot shaft 18 is fixed to outer arm 14, by way of non-limiting example only, with one or more of interference fit between pivot shaft 18 and first pivot shaft aperture 46*a* and second pivot shaft aperture 46*b*, welding, and staking.

Inner arm 12 may be planar as shown and includes an inner arm first side 48*a* which faces toward first wall 28*a* and also includes an inner arm second side 48*b* which is parallel to first side 48*a* and which faces toward second wall 28*b*. Inner arm 12 includes an inner arm roller shaft aperture 50 which extends therethrough from first side 48*a* to second side 48*b* such that inner arm roller shaft aperture 50 is centered about, and extends along, roller shaft axis 24. Roller shaft 22 extends through inner arm roller shaft aperture 50 such that roller shaft 22 and inner arm roller shaft aperture 50 are sized to interface in a close-sliding fit or an interference fit such that roller shaft 22 is prevented from moving radially within inner arm roller shaft aperture 50. Roller shaft 22 extends from first side 48*a* toward first wall 28*a* of outer arm 14 and similarly, roller shaft 22 also extends from second side 48*b* toward second wall 28*b* of outer arm 14. Roller shaft 22 may be left unfixed within inner arm roller shaft aperture 50 in a close sliding fit, but, may alternatively be fixed to inner arm 12, by way of non-limiting example only, with one or more of interference fit between roller shaft 22 and inner arm roller shaft aperture 50 and welding. Inner arm 12 also includes an inner arm pivot shaft aperture 52 which extends therethrough from first side 48*a* to second side 48*b* such that inner arm pivot shaft aperture 52 is centered about, and extends along, pivot axis 18*a*. Pivot shaft 18 extends through inner arm pivot shaft aperture 52 such that pivot shaft 18 and inner arm pivot shaft aperture 52 are sized to interface in a close-slide fit such that pivot shaft 18 is prevented from moving radially within inner arm pivot shaft aperture 52 while allowing inner arm 12 to pivot about pivot shaft 18.

First lost motion spring 30*a* and second lost motion spring 30*b* are each coil torsion springs which are supported by first spring boss 42*a* and second spring boss 42*b* respectively. First lost motion spring 30*a* includes a plurality of coils, thereby defining a first lost motion spring aperture 54*a* within which first spring boss 42*a* is located. First lost motion spring 30*a* is retained to first spring boss 42*a* by a first lost motion spring retainer 55*a* which includes a first spring retainer retention section 55*b* which surrounds and grips first spring boss 42*a* and also includes a first spring retainer flange 55*c* which extends radially outward therefrom such that first lost motion spring 30*a* is captured between first wall 28*a* and first spring retainer flange 55*c*. Similarly, second lost motion spring 30*b* includes a plurality of coils, thereby defining a second lost motion spring aperture 54*b* within which second spring boss 42*b* is located. Second lost motion spring 30*b* is retained to second spring boss 42*b* by a second lost motion spring retainer 55*d* which includes a second spring retainer retention section 55*e* which surrounds and grips second spring boss 42*b* and also includes a second spring retainer flange 55*f* which extends radially outward therefrom such that second lost motion spring 30*b* is captured between second wall 28*b* and second spring retainer flange 55*f*. First lost motion spring 30*a* includes a first lost motion spring outer arm tang 56*a* at one end thereof which is grounded to outer arm 14 at first wall step 28*c* of outer arm body 38 and also includes a first lost motion spring inner arm tang 58*a* at the other end thereof which is grounded to inner arm 12 as will be described in greater detail later. Similarly, second lost motion spring 30*b* includes a second lost motion spring outer arm tang 56*b* at one end thereof which is grounded to outer arm 14 at second wall step 28*d* of outer arm body 38 and also includes a second lost motion spring inner arm tang 58*b* at the other end thereof which is grounded to inner arm 12 as will be described in greater detail later.

A first roller retainer 64*a* is provided in order to retain first roller 20*a* and first bearings 26*a* and also in order to ground first lost motion spring inner arm tang 58*a* to inner arm 12 and similarly, a second roller retainer 64*b* is provided between second roller 20*b* and second wall 28*b* of outer arm 14 in order to retain second roller 20*b* and second bearings 26*b* and also in order to ground second lost motion spring inner arm tang 58*b* to inner arm 12. First roller retainer 64*a* includes a first roller retainer roller shaft aperture 66*a* which extends therethrough such that first roller retainer roller shaft aperture 66*a* is centered about, and extends along, roller shaft axis 24 and such that roller shaft 22 extends into first roller retainer roller shaft aperture 66*a*. First roller retainer roller shaft aperture 66*a* is sized to interface with roller shaft 22 in a close sliding fit such that radial movement of first roller retainer 64*a* relative to roller shaft 22 is prevented while allowing roller shaft 22 to rotate freely relative to first roller retainer 64*a* about roller shaft axis 24. In this way, first roller retainer 64*a* is carried by roller shaft 22. Alternatively, first roller retainer 64*a* may be fixed to roller shaft 22, for example, by interference fit or welding, thereby preventing roller shaft 22 from rotating relative to first roller retainer 64*a*. First roller retainer 64*a* extends to second end 14*b* where first roller retainer 64*a* includes a first roller retainer pivot shaft aperture 68*a* which extends therethrough such that first roller retainer pivot shaft aperture 68*a* is centered about, and extends along, pivot axis 18*a* and such that pivot shaft 18 extends through first roller retainer pivot shaft aperture 68*a*. First roller retainer pivot shaft aperture 68*a* is sized to interface with pivot shaft 18 in a close sliding fit such that radial movement of first roller retainer 64*a* relative to pivot shaft 18 is prevented while allowing first roller retainer 64*a* to rotate freely about pivot axis 18*a* on pivot shaft 18. In this way, first roller retainer 64*a* is also carried by pivot shaft 18, and since roller shaft 22 extends into first roller retainer roller shaft aperture 66*a*, first roller retainer 64*a* pivots together with inner arm 12 about pivot axis 18*a*. A first roller retainer first portion 64*a*1 of first roller retainer 64*a* which includes first roller retainer 64*a* is located axially, i.e. in the direction parallel to roller shaft axis 24, between first roller 20*a* and first wall 28*a* and is perpendicular to roller shaft axis 24 while a first roller retainer second portion 64*a*2 of first roller retainer 64*a* which includes first roller retainer pivot shaft aperture 68*a* is located axially, i.e. in the direction parallel to pivot axis 18*a*, between inner arm 12 and first wall 28*a* and is perpendicular to pivot axis 18*a*. In order to accommodate first wall step 28*e*, first roller retainer 64*a* includes a first roller retainer step 70*a* which is located between first roller retainer first portion 64*a*1 and first roller retainer second portion 64*a*2 such that first roller retainer step 70*a* axially offsets first roller retainer second portion 64*a*2 from first roller retainer first portion 64*a*1 toward inner arm 12 in the direction parallel to pivot axis 18*a*. First roller retainer first portion 64*a*1 extends radially outward from first roller retainer roller shaft aperture 66*a* to cause first roller retainer first portion 64*a*1 to be axially aligned, i.e. in the direction of roller shaft axis 24, with first bearings 26*a* and also to be axially aligned with first roller 20*a*. Consequently, first roller 20*a* and first bearings 26*a* are constrained axially between inner arm first side 48*a* and first roller retainer first portion 64*a*1 of first roller retainer 64*a*. It should be noted that first roller retainer step 70*a* is located between first roller 20*a* and pivot shaft 18. First roller retainer 64*a* includes a first roller retainer grounding member 72*a* which engages first lost motion spring inner arm tang 58*a* to urge inner arm 12 to rotate about pivot axis 18*a* in the first direction, i.e. clockwise as viewed in FIGS. 3 and 4. As should now be apparent, first roller retainer 64*a* may be made from stamping and forming sheet metal through common stamping, punching, and bending techniques.

Similar to first roller retainer 64*a*, second roller retainer 64*b* includes a second roller retainer roller shaft aperture 66*b* which extends therethrough such that second roller retainer roller shaft aperture 66*b* is centered about, and extends along, roller shaft axis 24 and such that roller shaft 22 extends into second roller retainer roller shaft aperture 66*b*. Second roller retainer roller shaft aperture 66*b* is sized to interface with roller shaft 22 in a close sliding fit such that radial movement of second roller retainer 64*b* relative to roller shaft 22 is prevented while allowing roller shaft 22 to rotate freely relative to second roller retainer 64*b* about roller shaft axis 24. In this way, second roller retainer 64*b* is carried by roller shaft 22. Alternatively, second roller retainer 64*b* may be fixed to roller shaft 22, for example, by interference fit or welding, thereby preventing roller shaft 22 from rotating relative to second roller retainer 64*b*. Second roller retainer 64*b* extends to second end 14*b* where second roller retainer 64*b* includes a second roller retainer pivot shaft aperture 68*b* which extends therethrough such that second roller retainer pivot shaft aperture 68*b* is centered about, and extends along, pivot axis 18*a* and such that pivot shaft 18 extends through second roller retainer pivot shaft aperture 68*b*. Second roller retainer pivot shaft aperture 68*b* is sized to interface with pivot shaft 18 in a close sliding fit such that radial movement of second roller retainer 64*b* relative to pivot shaft 18 is prevented while allowing second roller retainer 64*b* to rotate freely about pivot axis 18*a* on pivot shaft 18. In this way, second roller retainer 64*b* is also carried by pivot shaft 18, and since roller shaft 22 extends into second roller retainer roller shaft aperture 66*b*, second roller retainer 64*b* pivots together with inner arm 12 about pivot axis 18*a*. A second roller retainer first portion 64*b*1 of second roller retainer 64*b* which includes second roller retainer 64*b* is located axially, i.e. in the direction parallel to roller shaft axis 24, between second roller 20*b* and second wall 28*b* and is perpendicular to roller shaft axis 24 while a second roller retainer second portion 64*b*2 of second roller retainer 64*b* which includes second roller retainer pivot shaft aperture 68*b* is located axially, i.e. in the direction parallel to pivot axis 18*a*, between inner arm 12 and second wall 28*b* and is perpendicular to pivot axis 18*a*. In order to accommodate second wall step 28*f*, second roller retainer 64*b* includes a second roller retainer step 70*b* which is located between second roller retainer first portion 64*b*1 and second roller retainer second portion 64*b*2 such that second roller retainer step 70*b* axially offsets second roller retainer second portion 64*b*2 from second roller retainer first portion 64*b*1 toward inner arm 12 in the direction parallel to pivot axis 18*a*. Second roller retainer first portion 64*b*1 extends radially outward from second roller retainer roller shaft aperture 66*b* to cause second roller retainer first portion 64*b*1 to be axially aligned, i.e. in the direction parallel to roller shaft axis 24, with second bearings 26*b* and also to be axially aligned with second roller 20*b*. Consequently, second roller 20*b* and second bearings 26*b* are constrained axially between inner arm second side 48*b* and second roller retainer first portion 64*b*1 of second roller retainer 64*b*. It should be noted that second roller retainer step 70*b* is located between second roller 20*b* and pivot shaft 18. Second roller retainer 64*b* includes a second roller retainer grounding member 72*b* which engages second lost motion spring inner arm tang 58*b* to urge inner arm 12 to rotate about pivot axis 18*a* in the second direction, i.e. clockwise as viewed in FIGS. 3 and 4. As should now be apparent, second roller retainer 64*b* may be made from stamping and forming sheet metal through common stamping, punching, and bending techniques.

Figure 3:
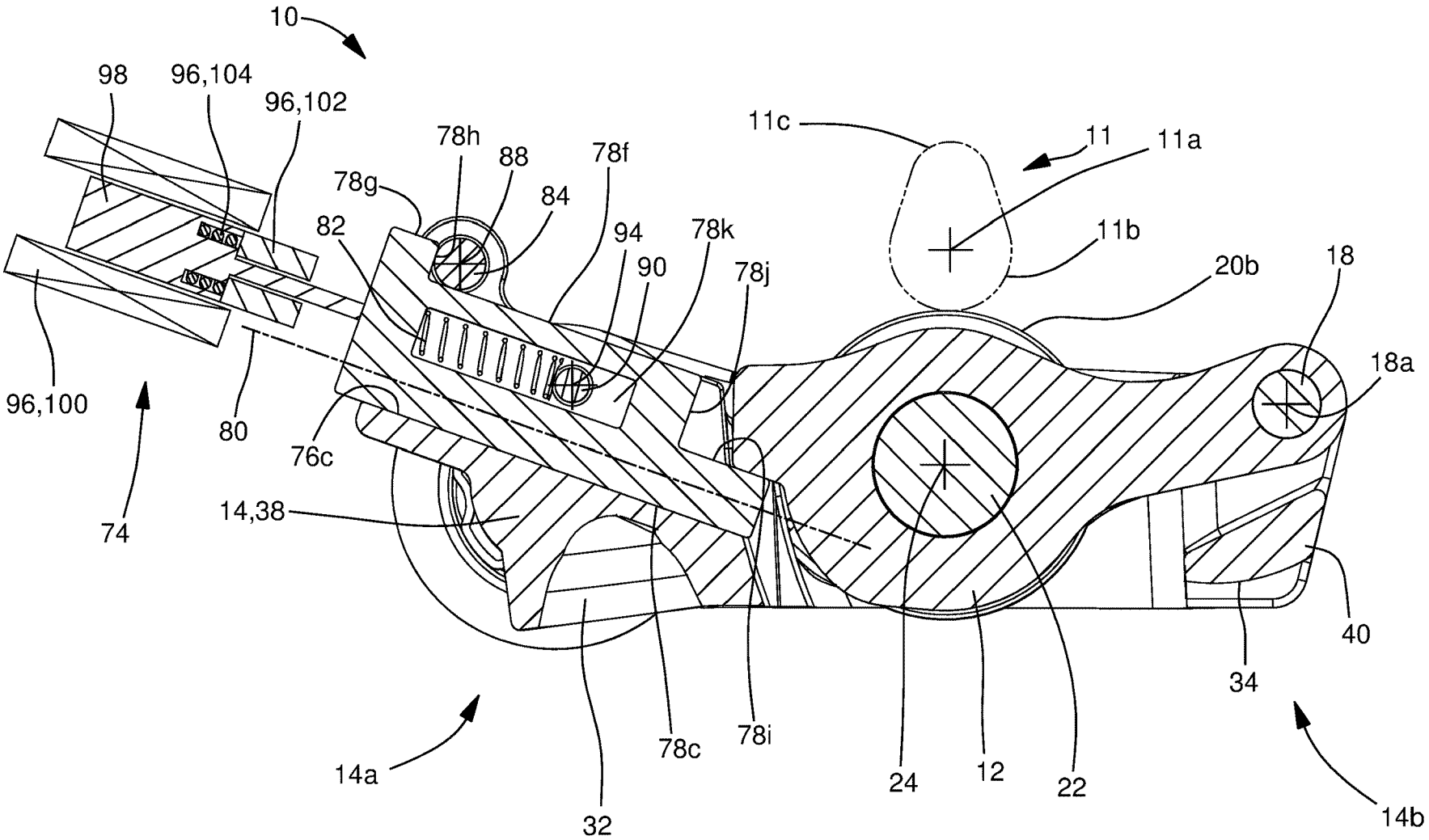
FIG. 3 is a cross-sectional view of the rocker arm of FIG. 1, taken through a plane that is perpendicular to an axis of rotation of rollers of an inner arm of the rocker arm, showing a latching arrangement of the rocker arm in a coupled state.
Figure 4:
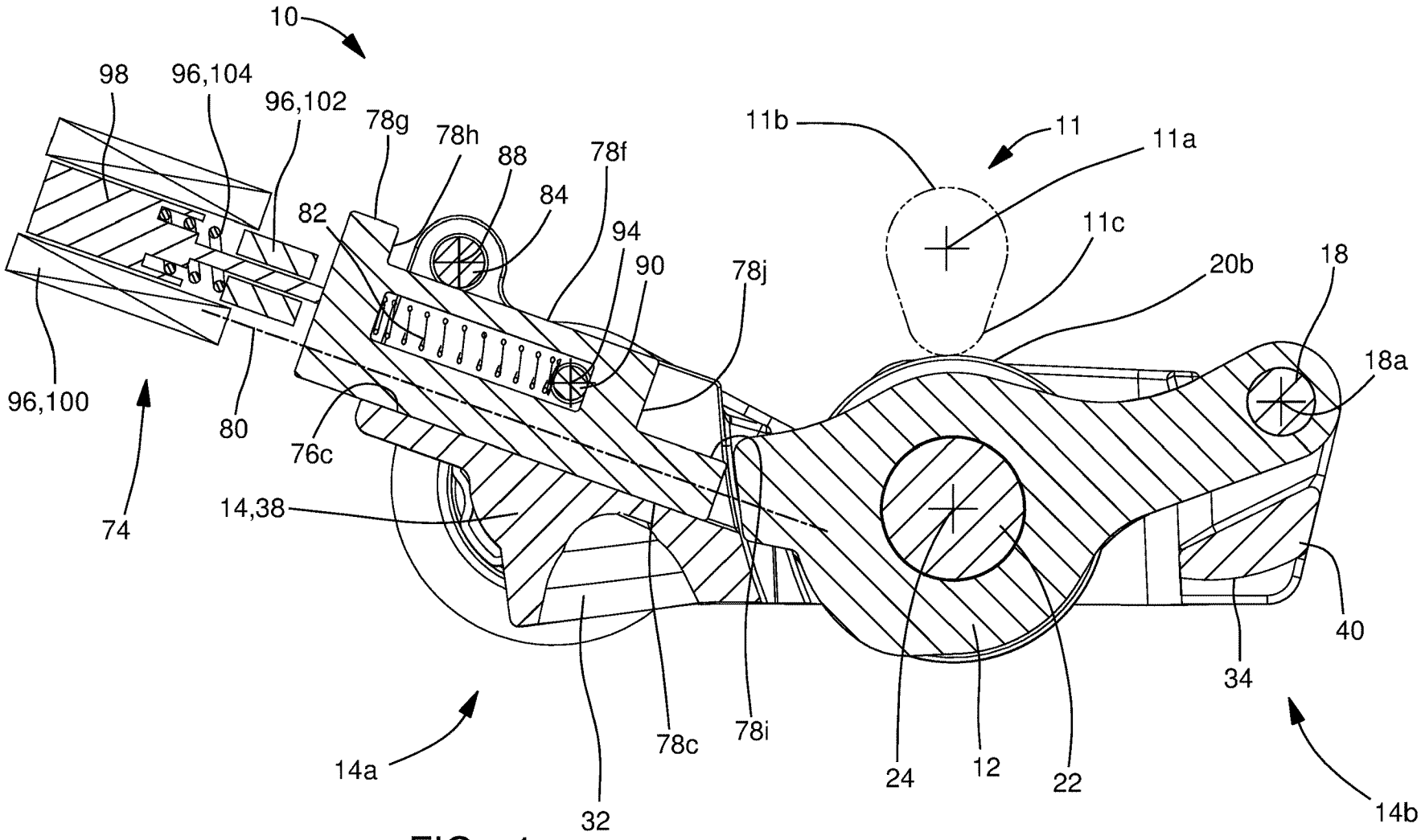
FIG. 4 is the cross-sectional view of FIG. 3, now showing the latching arrangement in a decoupled state.
Figure 5:
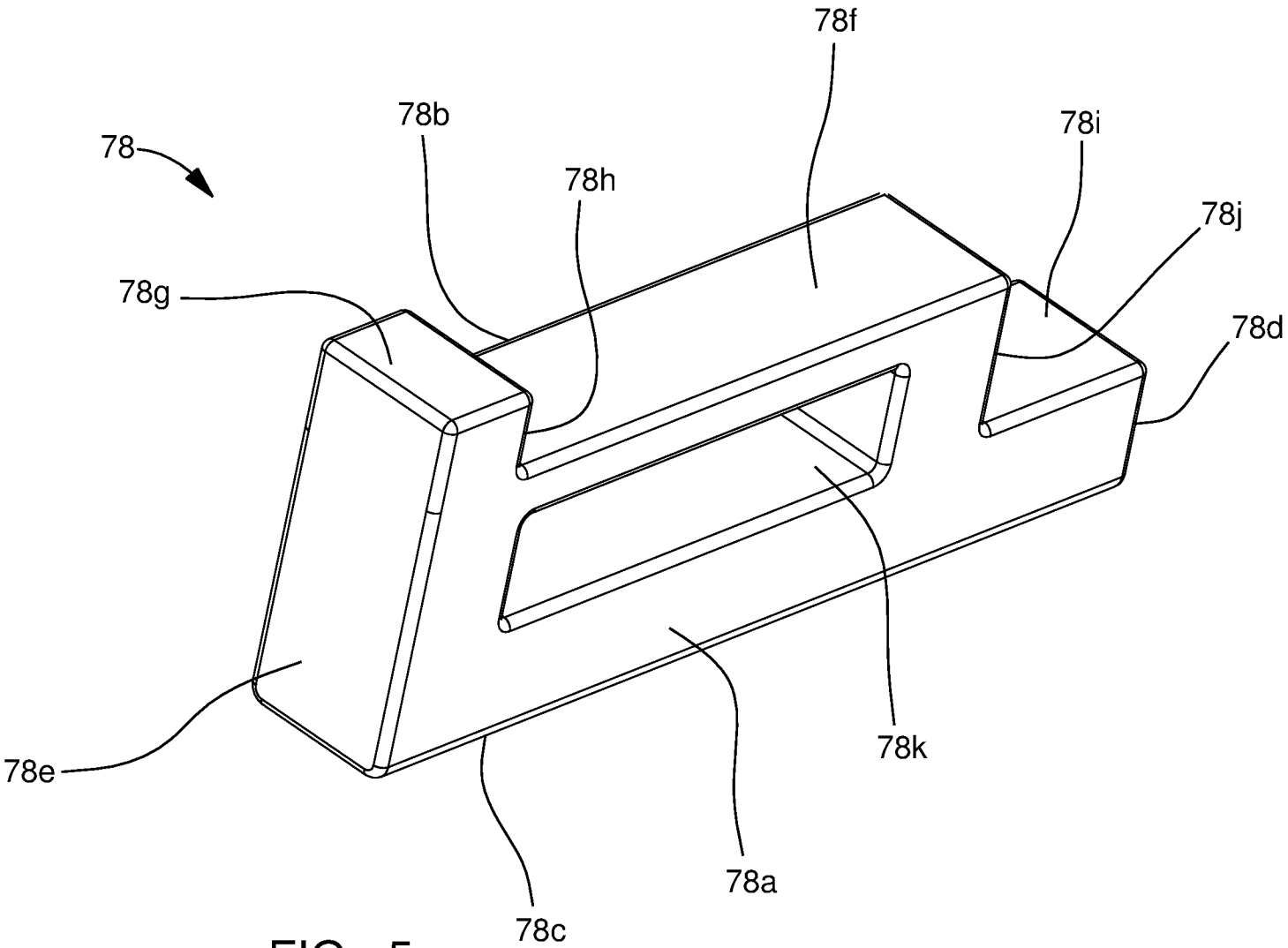
FIG. 5 is an enlarge isometric view of a lock member of the latching arrangement.

Rocker arm 10 is selectively switched between a coupled state and a decoupled state by latching arrangement 36 which is actuated, by way of non-limiting example only, by a solenoid actuator 74. In the coupled state as shown in FIG. 3, inner arm 12 is prevented from pivoting relative to outer arm 14 past a predetermined position of inner arm 12 relative to outer arm 14 in the second direction which is counterclockwise as viewed in FIG. 3. In this way, in the coupled state, inner arm 12, and therefore roller shaft 22, is coupled to outer arm 14, and rotation of lifting portion 11*c* is transferred from first roller 20*a* and second roller 20*b* through roller shaft 22 to pivotal movement of outer arm 14 about the lash adjuster which, in turn, reciprocates the associated valve. In the decoupled state as shown in FIG. 4, inner arm 12 is able to pivot relative to outer arm 14 past the predetermined position in the first direction. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12, together with first roller 20*a*, second roller 20*b*, and roller shaft 22, reciprocate within central opening 16, thereby compressing and uncompressing first lost motion spring 30*a* and second lost motion spring 30*b* in a cyclic manner such that first lost motion spring 30*a* and second lost motion spring 30*b* bias inner arm 12 to pivot relative to outer arm 14 in the first direction, shown as clockwise as viewed in FIG. 4.

Latching arrangement 36 will now be described in greater detail. Latching arrangement 36 includes a lock member channel 76 which is formed between first wall 28*a* and second wall 28*b* and which opens into central opening 16. Latching arrangement 36 also includes lock member 78 which is slidably disposed in lock member channel 76 such that lock member 78 moves within lock member channel 76 along a lock member axis 80. Lock member 78 selectively engages inner arm 12 as shown in FIG. 3, thereby preventing inner arm 12 from pivoting relative to outer arm 14 in the second direction past the predetermined position. Lock member 78 also selectively disengages inner arm 12 as shown in FIG. 4, thereby allowing inner arm 12 to pivot relative to outer arm 14 in the second direction past the predetermined position. Latching arrangement 36 also includes a return spring 82 which urges lock member 78 out of engagement with inner arm 12 when desired, as shown in FIG. 4, to achieve the decoupled state.

Lock member channel 76 is formed by a first wall surface 76*a*, a second wall surface 76*b* which is opposed to first wall surface 76*a*, and a third wall surface 76*c* which joins first wall surface 76*a* to second wall surface 76*b*. It is important to note that lock member channel 36 as provided by outer arm 14 is open in a direction opposed to third wall surface 76*c*, i.e. away from third wall surface 76*c*. First wall surface 76*a* and second wall surface 76*b* are preferably each planar and parallel to each other such that first wall surface 76*a* is provided on first wall 28*a* and such that second wall surface 76*b* is provided on second wall 28*b*. Third wall surface 76*c* is also preferably planar and is perpendicular to first wall surface 76*a* and second wall surface 76*b*.

Lock member 78 includes a first lock member surface 78*a* which faces toward first wall surface 76*a* of lock member channel 76 and also includes a second lock member surface 78*b* which faces toward second wall surface 76*b* of lock member channel 76. First lock member surface 78*a* and second lock member surface 78*b* are each preferably planar and parallel to each other. Lock member 78 also includes a third lock member surface 78*c* which joins first lock member surface 78*a* to second lock member surface 78*b* and faces toward third wall surface 76*c* of lock member channel 76. Third lock member surface 78*c* engages third wall surface 76*c* such that third lock member surface 78*c* slides across third wall surface 76*c* when lock member 78 moves between the coupled position and the decoupled position. Lock member 78 extends in the direction of lock member axis 80 from a lock member first end 78*d*, which is proximal to inner arm 12, to a lock member second end 78*e* which is distal from inner arm 12. Lock member first end 78*d* and lock member second end 78*e* may be perpendicular to first lock member surface 78*a* and third lock member surface 78*c* as shown. Lock member 78 also includes a fourth lock member surface 78*f* which is opposed to, and laterally offset from, third lock member surface 78*c* and which is preferably parallel to third lock member surface 78*c*. Fourth lock member surface 78*f* joins first lock member surface 78*a* to second lock member surface 78*b*. Lock member 78 also includes a fifth lock member surface 78*g* which is opposed to, and laterally offset from, third lock member surface 78*c* by a distance which is greater than fourth lock member surface 78*f* being offset from third lock member surface 78*c*, thereby forming a first lock member shoulder 78*h* which joins fourth lock member surface 78*f* to fifth lock member surface 78*g*. Lock member 78 also includes a sixth lock member surface 78*i* which is opposed to, and laterally offset from, third lock member surface 78*c* by a distance which is less than fourth lock member surface 78*f* being offset from third lock member surface 78*c*, thereby forming a second lock member shoulder 78*j* which joins fourth lock member surface 78*f* to sixth lock member surface 78*i*. Sixth lock member surface 78*i* engages and blocks inner arm 12 from rotating past the predetermined position when lock member 78 is in the coupled position.

Lock member 78 also includes a lock member aperture 78*k* extending therethrough from first lock member surface 78*a* to second lock member surface 78*b* such that lock member aperture 78*k* is open toward first wall surface 76*a* of lock member channel 76 and is also open toward second wall surface 76*b* of lock member channel 76. Return spring 82 is located within lock member aperture 78*k* and urges lock member 78 toward the decoupled position as will be described in greater detail later.

Rocker arm 10 includes a lock member retainer 84 which is spaced apart from, and opposed to, third wall surface 76*c* such that lock member 78 is captured between lock member retainer 84 and third wall surface 76*c*. In this way, movement of lock member 78 away from third wall surface 76*c* in a direction perpendicular to lock member axis 80 is limited by lock member retainer 84. First wall 28*a* includes a first wall aperture 86*a* extending therethrough while second wall 28*b* includes a second wall aperture 86*b* such that first wall aperture 86*a* and second wall aperture 86*b* are each centered about, and extend along, a lock member retainer axis 88 which is parallel to pivot axis 18*a*. First wall aperture 86*a* and second wall aperture 86*b* are each preferably cylindrical. Lock member retainer 84 is located within each of first wall aperture 86*a* and second wall aperture 86*b* and is preferably cylindrical. Lock member retainer 84 is fixed to outer arm 14, by way of non-limiting example only by interference fit with one or more of first wall aperture 86*a* and second wall aperture 86*b*, welding, adhesives, threaded connection, two or more of the foregoing, and the like. As can be seen in the figures, fourth lock member surface 78*f* faces toward lock member retainer 84. In addition to limiting movement of lock member 78 away from third wall surface 76*c* in a direction perpendicular to lock member axis 80, lock member retainer 84 also limits travel of lock member 78 along lock member axis 80 by engaging first lock member shoulder 78*h* only when lock member 78 is in the coupled position.

Rocker arm 10 also includes a lock member travel stop 90 which is fixed to outer arm 14 and which passes through lock member aperture 78*k*. Lock member travel stop 90 serves to limit travel of lock member 78 in the decoupled state. Additionally, return spring 82 is grounded to lock member travel stop 90. Outer arm 14 includes a first outer arm aperture 92*a* extending thereinto from first wall surface 76*a* and a second outer arm aperture 92*b* extending thereinto from second wall surface 76*b* such that each of first outer arm aperture 92*a* and second outer arm aperture 92*b* are centered about, and extend along, a lock member travel stop axis 94 which is parallel to lock member retainer axis 88. First wall aperture 86*a* and second wall aperture 86*b* are each preferably cylindrical. Lock member travel stop 90 is located within each of first outer arm aperture 92*a* and second outer arm aperture 92*b* and is preferably cylindrical. Lock member travel stop 90 is fixed to outer arm 14, by way of non-limiting example only, by interference fit with one or more of first wall aperture 86*a* and second wall aperture 86*b*, welding, adhesives, threaded connection, two or more of the foregoing, and the like.

Solenoid actuator 74 will now be described in limited detail. Solenoid actuator 74 includes a solenoid fixed portion 96 and a solenoid moveable portion 98 where solenoid fixed portion 96 includes a wire winding 100, a pole piece 102, and a solenoid return spring 104 which are shown schematically only in FIGS. 3 and 4 and which are widely known to those of ordinary skill in the art and will not be described further herein. Solenoid moveable portion 98 is an armature which is magnetically attracted to pole piece 102 upon application of an electric current to wire winding 100. Consequently, when an electric current is applied to the wire winding 100, solenoid moveable portion 98 moves toward pole piece 102, thereby compressing solenoid return spring 104 and moving lock member 78 to the coupled position. Conversely, when the electric current to wire winding 100 is stopped, solenoid return spring 104 moves solenoid moveable portion 98 away from pole piece 102, thereby causing return spring 82 to move lock member 78 to the decoupled position. Alternatively, solenoid return spring 104 may be omitted and return spring 82 may provide the function of moving solenoid moveable portion 98 away from pole piece 102. Solenoids, their elements, and their operation are well known to those of ordinary skill in the art, and consequently, solenoid actuator 74 will not be described in greater detail herein.

While rocker arm 10 has been illustrated herein as defaulting to the decoupled position, it should be understood that rocker arm 10 may alternatively be arranged to defaulting to coupled position by reversing the direction that return spring 82 urges lock member 78. Additionally, solenoid actuator 74 would need to be reconfigured to either push lock member 78 from the opposite direction or to apply a pulling force to lock member 78.

In a variation, lock member retainer 84 may be omitted, and its retention function may be replaced by lock member travel stop 90 which prevents removal of lock member 78 since lock member travel stop 90 is captured within lock member aperture 78*k* and could thereby be used to retain lock member 78.

Latching arrangement 36, including lock member channel 76 and lock member 78, is simple and economic to produce. For example, lock member channel 76 may be formed in a simple milling operation while lock member 78 may be formed from flat stock. Additionally, retention of lock member 78 is provided by one or more of lock member retainer 84 and lock member travel stop 90 which can be simple dowel pins or roll pins which are widely commercially available at minimal cost.

While this invention has been described in terms of preferred embodiments thereof, it is not intended to be so limited, but rather only to the extent set forth in the claims that follow.

I claim:

1. A rocker arm for transmitting rotational motion from a camshaft to opening and closing motion of a combustion valve in an internal combustion engine, said rocker arm comprising:

an outer arm having a first wall surface, a second wall surface opposed to, and spaced apart from, said first wall surface, and a third wall surface which joins said first wall surface to said second wall surface, said first wall surface, said second wall surface, and said third wall surface together forming a lock member channel which is open in a direction away from said third wall surface;

an inner arm which selectively pivots relative to said outer arm about a pivot axis;

a lost motion spring which biases said inner arm to pivot relative to said outer arm in a first direction about said pivot axis;

a lock member located within said lock member channel, wherein said lock member moves along a lock member axis between 1) a coupled position in which said lock member prevents said inner arm from pivoting about said pivot axis relative to said outer arm past a predetermined position of said inner arm relative to said outer arm in a second direction which is opposite of said first direction and 2) a decoupled position in which said lock member permits said inner arm to pivot relative to said outer arm past said predetermined position in said second direction about said pivot axis; and a lock member retainer which is spaced apart from, and opposed to, said third wall surface such that said lock member is captured between said lock member retainer and said third wall surface, thereby limiting movement of said lock member away from said third wall surface in the direction away from said third wall surface which is perpendicular to said lock member axis wherein said first wall surface, said second wall surface, and said third wall surface extend along a common portion of said lock member axis.

2. The rocker arm as in claim 1, wherein:

said first wall surface is provided on a first wall which includes a first wall aperture;

said second wall surface is provided on a second wall which includes a second wall aperture; and said lock member retainer is located within said first wall aperture and said second wall aperture.

3. The rocker arm as in claim 2, wherein said first wall aperture and said second wall aperture each extend along a lock member retainer axis which is parallel to said pivot axis.

4. The rocker arm as in claim 2, wherein said first wall aperture and said second wall aperture are each cylindrical.

5. The rocker arm as in claim 4, wherein said lock member retainer is cylindrical.

6. The rocker arm as in claim 1, wherein:

said first wall surface is planar; and said second wall surface is planar and is parallel to said first wall surface.

7. The rocker arm as in claim 6, wherein said lock member includes:

a first lock member surface which faces toward said first wall surface;

a second lock member surface which faces toward said second wall surface and which is parallel to said first lock member surface; and a third lock member surface which joins said first lock member surface to said second lock member surface and which faces toward said third wall surface.

8. The rocker arm as in claim 7, wherein;

said lock member includes a fourth lock member surface which faces toward said lock member retainer and which is laterally offset from said third lock member surface by a first distance;

said lock member includes a fifth lock member surface which is laterally offset from said third lock member surface by a second distance which is greater than said first distance, thereby forming a lock member shoulder which joins said fourth lock member surface and said fifth lock member surface; and said lock member shoulder limits travel of said lock member by engaging said lock member retainer only when said lock member is in said coupled position.

9. The rocker arm as in claim 8, wherein:

said third lock member surface is planar; and said fourth lock member surface is planar and parallel to said third lock member surface.

10. The rocker arm as in claim 8, wherein said lock member shoulder is perpendicular to said third lock member surface.

11. The rocker arm as in claim 7, wherein:

said first lock member surface is planar; and said second lock member surface is planar.

12. The rocker arm as in claim 1, wherein said outer arm includes an outer arm first wall and an outer arm second wall such that said outer arm first wall and said outer arm second wall are spaced apart from each other, said outer arm first wall and said outer arm second wall having respective surfaces which define a central opening within which said inner arm is located.

13. The rocker arm as in claim 12, wherein said respective surfaces of said outer arm first wall and said outer arm second wall are distinct from said first wall surface and said second wall surface.

14. A rocker arm for transmitting rotational motion from a camshaft to opening and closing motion of a combustion valve in an internal combustion engine, said rocker arm comprising:

an outer arm having a first wall surface, a second wall surface opposed to, and spaced apart from, said first wall surface, and a third wall surface which joins said first wall surface to said second wall surface, said first wall surface, said second wall surface, and said third wall surface together forming a lock member channel which is open in a direction away from said third wall surface;

an inner arm which selectively pivots relative to said outer arm about a pivot axis;

a lost motion spring which biases said inner arm to pivot relative to said outer arm in a first direction about said pivot axis;

a lock member located within said lock member channel, wherein said lock member moves along a lock member axis between 1) a coupled position in which said lock member prevents said inner arm from pivoting about said pivot axis relative to said outer arm past a predetermined position of said inner arm relative to said outer arm in a second direction which is opposite of said first direction and 2) a decoupled position in which said lock member permits said inner arm to pivot relative to said outer arm past said predetermined position in said second direction about said pivot axis; and a lock member retainer which is spaced apart from, and opposed to, said third wall surface such that said lock member is captured between said lock member retainer and said third wall surface, thereby limiting movement of said lock member away from said third wall surface in the direction away from said third wall surface which is perpendicular to said lock member axis;

wherein said first wall surface is planar;

wherein said second wall surface is planar and is parallel to said first wall surface; and wherein said lock member includes:

a first lock member surface which faces toward said first wall surface;

a second lock member surface which faces toward said second wall surface and which is parallel to said first lock member surface; and a third lock member surface which joins said first lock member surface to said second lock member surface and which faces toward said third wall surface wherein said third lock member surface engages said third wall surface such that said third lock member surface slides across said third wall surface when said lock member moves between said coupled position and said decoupled position.

15. A rocker arm for transmitting rotational motion from a camshaft to opening and closing motion of a combustion valve in an internal combustion engine, said rocker arm comprising:

an outer arm having a first wall surface, a second wall surface opposed to, and spaced apart from, said first wall surface, and a third wall surface which joins said first wall surface to said second wall surface, said first wall surface, said second wall surface, and said third wall surface together forming a lock member channel which is open in a direction away from said third wall surface;

an inner arm which selectively pivots relative to said outer arm about a pivot axis;

a lost motion spring which biases said inner arm to pivot relative to said outer arm in a first direction about said pivot axis;

a lock member located within said lock member channel, wherein said lock member moves along a lock member axis between 1) a coupled position in which said lock member prevents said inner arm from pivoting about said pivot axis relative to said outer arm past a predetermined position of said inner arm relative to said outer arm in a second direction which is opposite of said first direction and 2) a decoupled position in which said lock member permits said inner arm to pivot relative to said outer arm past said predetermined position in said second direction about said pivot axis; and a lock member retainer which is spaced apart from, and opposed to, said third wall surface such that said lock member is captured between said lock member retainer and said third wall surface, thereby limiting movement of said lock member away from said third wall surface in the direction away from said third wall surface which is perpendicular to said lock member axis;

wherein said first wall surface is planar;

wherein said second wall surface is planar and is parallel to said first wall surface;

wherein said lock member includes:

a first lock member surface which faces toward said first wall surface;

a second lock member surface which faces toward said second wall surface and which is parallel to said first lock member surface; and a third lock member surface which joins said first lock member surface to said second lock member surface and which faces toward said third wall surface;

wherein said lock member includes a lock member aperture extending through said lock member from said first lock member surface to said second lock member surface; and wherein said rocker arm further comprises a lock member travel stop fixed to said outer arm which passes through said lock member aperture and which limits travel of said lock member in said decoupled position.

16. The rocker arm as in claim 15, wherein:

said outer arm includes a first outer arm aperture extending into said outer arm from said first wall surface;

said outer arm includes a second outer arm aperture extending into said outer arm from said second wall surface; and said lock member travel stop is located within said first outer arm aperture and said second outer arm aperture.

17. The rocker arm as in claim 15, wherein said lock member aperture is open toward said first wall surface and toward said second wall surface.

18. The rocker arm as in claim 15, wherein said rocker arm further comprises a return spring which is grounded to said lock member travel stop and urges said lock member toward said decoupled position.

19. The rocker arm as in claim 18, wherein said return spring is located within said lock member aperture.

* * * * *